US009320092B2

(12) United States Patent
Wu

(10) Patent No.: US 9,320,092 B2
(45) Date of Patent: Apr. 19, 2016

(54) ILLUMINATION DEVICE AND LED DIMMING CIRCUIT THEREOF

(71) Applicant: Lextar Electronics Corporation, Hsinchu (TW)

(72) Inventor: En-Min Wu, Taipei (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 14/158,872

(22) Filed: Jan. 20, 2014

(65) Prior Publication Data

US 2014/0327366 A1 Nov. 6, 2014

(30) Foreign Application Priority Data

May 3, 2013 (TW) ..... 102115896 A

(51) Int. Cl.
*H05B 37/02* (2006.01)
*H05B 33/08* (2006.01)

(52) U.S. Cl.
CPC ..... *H05B 33/0815* (2013.01)

(58) Field of Classification Search
CPC ..... H05B 33/0815; H05B 33/0818; H05B 37/029; H05B 37/02; H05B 41/3925; H05B 41/391; H05B 41/2828; H05B 33/0803
USPC ..... 315/291, 205, 206, 200 R, 224
See application file for complete search history.

(56) References Cited

U.S. PATENT DOCUMENTS 6,864,644 B2 * 3/2005 Kernahan ..... 315/307
7,619,368 B2 * 11/2009 Lu ..... 315/209 R
7,872,430 B2 * 1/2011 Roberts ..... G09G 3/3406 315/291
8,866,398 B2 * 10/2014 Ren ..... H02M 1/4258 315/219
2004/0095081 A1 * 5/2004 Kernahan ..... H05B 41/3927 315/307
2006/0071614 A1 * 4/2006 Tripathi et al. ..... 315/291
2006/0279970 A1 * 12/2006 Kernahan ..... 363/65
2007/0007902 A1 * 1/2007 Lu ..... 315/209 R
2010/0259185 A1 * 10/2010 Sadwick ..... H03K 17/72 315/291
2011/0227496 A1 * 9/2011 Lin et al. ..... 315/209 R
2012/0080944 A1 * 4/2012 Recker ..... H02J 9/02 307/25
2012/0187863 A1 * 7/2012 Nonaka et al. ..... 315/291
2012/0194078 A1 * 8/2012 Ren et al. ..... 315/122
2012/0249004 A1 * 10/2012 Kamata et al. ..... 315/206

(Continued)

FOREIGN PATENT DOCUMENTS

CN 101960922 A 1/2011
CN 102412727 A 4/2012

(Continued)

*Primary Examiner* — Douglas W Owens
*Assistant Examiner* — Syed M Kaiser
(74) *Attorney, Agent, or Firm* — CKC & Partners Co., LTD.

(57) ABSTRACT

An illumination device includes a light-emitting diode (LED) lamp and a LED dimming circuit. The LED dimming circuit includes a power converting module, a sensing unit and a dimming module. The power converting module is used to generate a driving voltage to drive the LED lamp. The sensing unit is used to generate a sensing voltage signal. The dimming module includes an input interface, a dimming signal generator and an isolating unit. The input interface is used to receive a dimming control signal. The dimming signal generator is used to output a first feedback signal based on the sensing voltage signal and the dimming control signal. The isolating unit is used to receive the first feedback signal and output a second feedback signal to the power converting module so as to control a driving current.

21 Claims, 2 Drawing Sheets

(56) References Cited

U.S. PATENT DOCUMENTS

| | | | | |
|---|---|---|---|---|
| 2012/0319604 | A1* | 12/2012 | Walters | H02M 3/1582 315/200 R |
| 2013/0049621 | A1* | 2/2013 | Yan et al. | 315/205 |
| 2013/0134892 | A1* | 5/2013 | Kado et al. | 315/206 |
| 2013/0193877 | A1* | 8/2013 | Kuo et al. | 315/307 |
| 2014/0091723 | A1* | 4/2014 | Kuo et al. | 315/200 R |
| 2014/0183946 | A1* | 7/2014 | Recker et al. | 307/23 |

FOREIGN PATENT DOCUMENTS

| | | | |
|---|---|---|---|
| CN | 102740571 | A | 10/2012 |
| CN | 102752907 | A | 10/2012 |
| TW | 201146081 | A | 12/2011 |
| TW | 201228467 | A | 7/2012 |

* cited by examiner

ILLUMINATION DEVICE AND LED DIMMING CIRCUIT THEREOF

RELATED APPLICATIONS

This application claims priority to Taiwan Application Serial Number 102115896, filed May 3, 2013, which is herein incorporated by reference.

BACKGROUND

1. Field of Invention

The present disclosure relates to an illumination device. More particularly, the present disclosure relates to a light-emitting diode (LED) dimming circuit of an illumination device.

2. Description of Related Art

As a result of a LED having the advantages of high illumination efficiency, longer service life, etc., various applications of using a white LED as a light source, such as liquid crystal displays and televisions, are more and more popular.

FIG. 1 is a schematic diagram showing a dimming circuit of a LED light source according to a prior art. As shown in FIG. 1, a dimming circuit of a common LED light source uses a two-stage driving circuit. A first-stage AC-to-DC converting module 120 is used to convert an AC voltage provided by mains supply to a DC voltage. A second-stage DC-to-DC converting module 140 converts the aforementioned DC voltage to a driving voltage required by a LED module 160. For achieving the purpose of the dimming control, the second-stage DC-to-DC converting module 140 is adjusted by an external dimming control signal $V_{dimming}$ in the dimming circuit 100, thereby changing the driving voltage of the LED module 160.

However, in the aforementioned dimming circuit, each of the first-stage AC-to-DC converting module 120 and the second-stage DC-to-DC converting sir module 140 has to work with a first control circuit 122 and a second control circuit 142 respectively, and adjusts and stabilizes its own outputting voltage through an additional feedback path. Thus, this design results in the problems of using more electronic components and having higher manufacturing cost. Further, because the two-stage driving circuit needs to undergo power conversion and voltage adjustment twice, the power conversion efficiency of the whole circuit is reduced.

In view of this, the aforementioned conventional dimming circuit is still inconvenient and deficient apparently, and needs further improvement. To solve the aforementioned problems, persons in the industry endeavor to search the solutions. However, a suitable dimming circuit is not completed for a long time. Therefore, how to simplify the LED dimming circuit and increase the overall power conversion efficiency is one of the important research topics, and is also a target that needs to be improved in the related fields.

SUMMARY

In order to solve the above problems, the present disclosure is to provide a LED dimming circuit for integrating a single-stage driving circuit into a dimming circuit to achieve the features of using simplified electronic components and power isolation, and to increase the power conversion efficiency.

An aspect of the present disclosure is to provide a LED dimming circuit. The LED dimming circuit includes a power converting module, a sensing unit and a dimming module. The power converting module is used for receiving a mains supply and generating a driving voltage to drive a LED. The sensing unit is used for converting a driving current flowing through the LED to a sensing voltage signal. The dimming module includes an input interface, a dimming signal generator and an isolating unit. The input interface is used for receiving a dimming control signal inputted from external. The dimming signal generator is used for outputting a first feedback signal based on the sensing voltage signal and the dimming control signal. The isolating unit is used for receiving the first feedback signal and outputting a second feedback signal to the power converting module, thereby feedback-controlling the driving current.

According to an embodiment of the present disclosure, the dimming module further includes an amplifier and a filter. The amplifier is used for amplifying the sensing voltage signal. The filter is used for converting the dimming control signal to a DC reference voltage signal, and the dimming signal generator is used for outputting the first feedback signal based on the amplified sensing voltage signal and the DC reference voltage signal.

According to an embodiment of the present disclosure, the filter includes a RC low pass filter.

According to an embodiment of the present disclosure, the dimming control signal is a pulse width modulation (PWM) signal.

According to an embodiment of the present disclosure, the sensing unit includes a sampling resistor, and one end of the sampling resistor is electrically connected to the LED, and the other end of the sampling resistor is electrically connected to a ground end for converting the driving current flowing through the LED to the sensing voltage signal.

According to an embodiment of the present disclosure, the power converting module includes a bridge-type rectifier, a transformer, a power switch and a control module. The bridge-type rectifier is used for converting the mains supply to a DC voltage. The transformer is used for outputting the driving current based on the DC voltage. The power switch is used for adjusting the driving current based on a power control signal. The control module is used for outputting the power control signal based on the second feedback signal.

According to an embodiment of the present disclosure, the isolating unit includes a photo coupler module for receiving the first feedback signal and outputting the second feedback signal.

Another aspect of the present disclosure is to provide a LED dimming circuit. The LED dimming circuit includes a power converting module, a sensing unit, an amplifier, an input interface, a filter, a dimming signal generator and an isolating unit. The power converting module is electrically connected to a LED. The sensing unit electrically is connected to the LED. The amplifier has an input end and an output end, and the input end of the amplifier is electrically connected to the sensing unit. The filter has an input end and an output end, and the input end of the filter is electrically connected to the input interface. The dimming signal generator has two input ends and an output end, and one of the two input ends of the dimming signal generator is electrically connected to the output end of the amplifier, and the other of the two input ends of the dimming signal generator is electrically connected to the output end of the filter. The isolating unit has an input end and an output end, and the input end of the isolating unit is electrically connected to the output end of the dimming signal generator, and the output end of the isolating unit is electrically connected to the power converting module.

Another aspect of the present disclosure is to provide an illumination device. The illumination device includes the aforementioned LED dimming circuit and a LED lamp. The light LED lamp is electrically connected to the aforementioned power converting module.

According to the above, compared with the conventional technology, the technical solution of the present disclosure has obvious advantages and beneficial effects. By using the aforementioned technical measures, the present disclosure can make quite a technical progress, and has wide industrial application values. The present disclosure can achieve using simplified electronic components by integrating a single-stage driving circuit into a dimming circuit. Further, the power conversion efficiency of the whole circuit can be also promoted.

BRIEF DESCRIPTION OF THE DRAWINGS

These and other features, aspects, advantages and embodiments of the present invention will become better understood with regard to the following accompanying drawings where.

DETAILED DESCRIPTION

It is understood that the following disclosure provides embodiments coordinating with the drawings appended herewith for detailed description. However, the provided embodiments are not used to be limiting the including scope of the present disclosure, and the description of the structural operation is not used to be limiting the sequence of conduction. Where any structures recombined therewith to produce a device having an equal effect, is the scope included by the present disclosure. Further, the purpose of the drawings are used to describe, and not illustrated according to the original size. For ease of understanding, the same elements are marked the same references to describe in the following description.

As used herein, the terms, such as "first", "second", are not specially designated as a series or in sequence and are not used to be limiting the present disclosure. These terms are only used to distinguish elements or operations that are described as the same terms.

Further, the term "connect" used herein can be designated as that two or more elements are direct or indirect to contact to each other physically or electrically, or as operations or actions within two or more elements.

Figure 1:
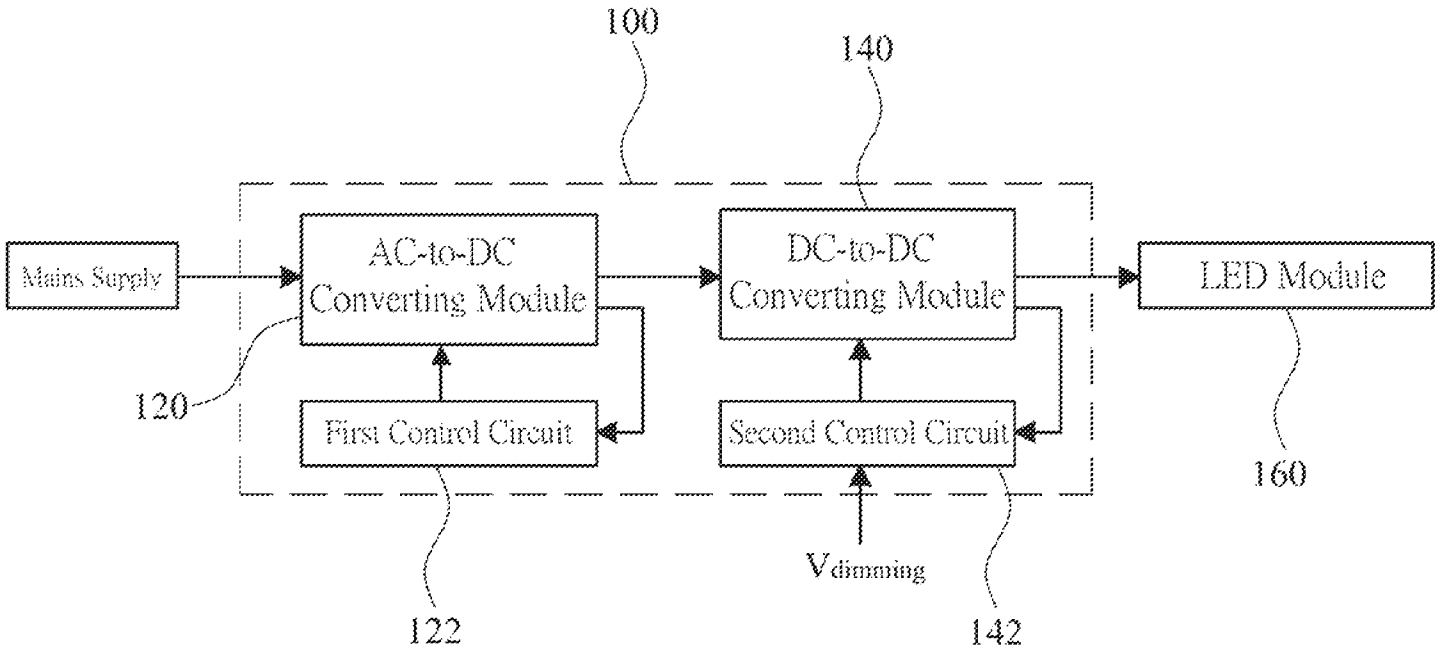
FIG. 1 is a schematic diagram showing a dimming circuit of a LED light source according to a prior art.
Figure 2:
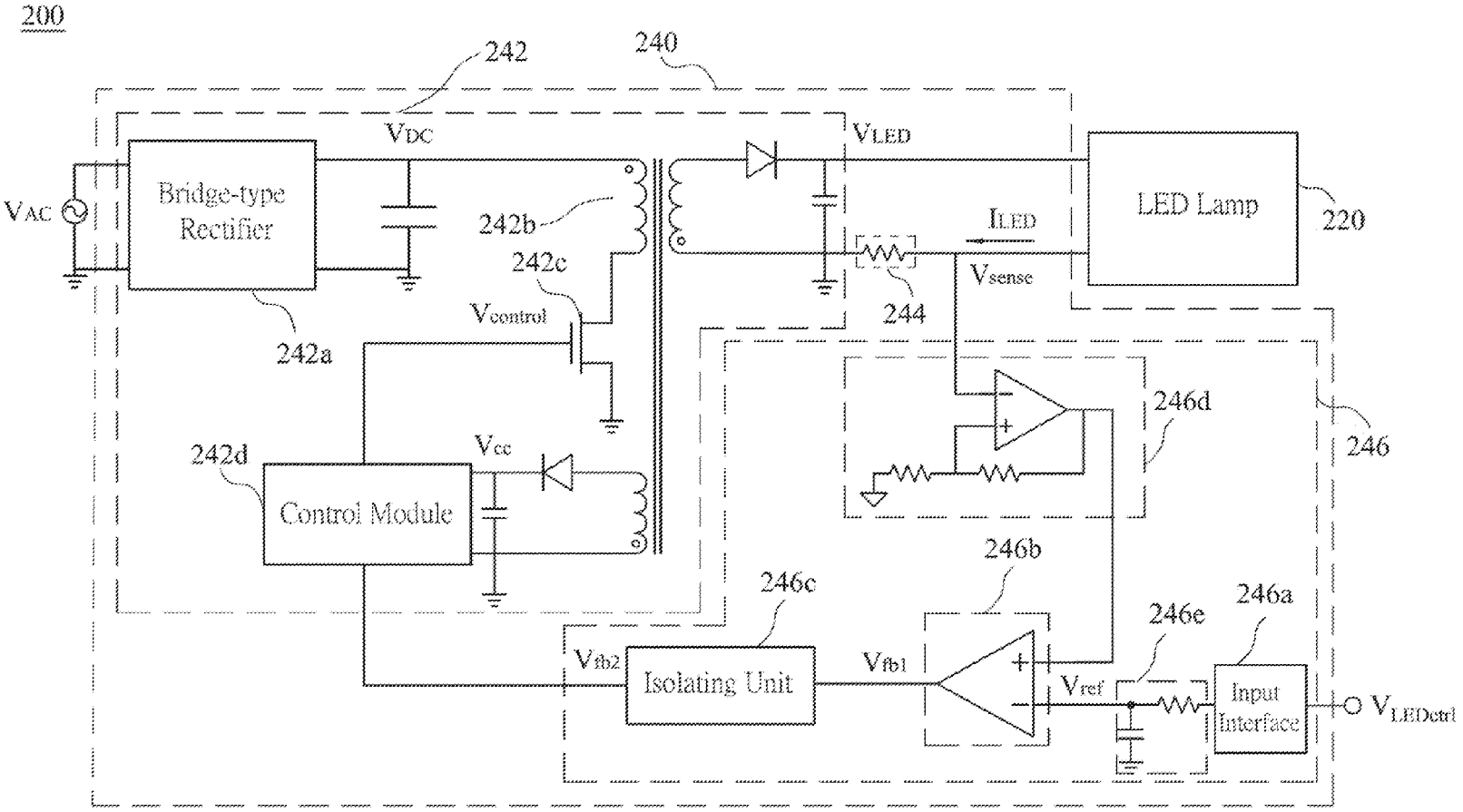
FIG. 2 is a schematic diagram showing an illumination device in accordance with an embodiment of the present disclosure.

FIG. 2 is a schematic diagram showing an illumination device in accordance with an embodiment of the present disclosure. As shown in FIG. 2, an illumination device 200 includes a LED lamp 220 and a LED dimming circuit 240. The LED lamp 220 includes at least one LED. The LED dimming circuit 240 includes a power converting module 242, a sensing unit 244 and a dimming module 246.

The LED lamp 220 is electrically connected to the power converting module 242. The power converting module 242 receives a mains supply $V_{AC}$ and generates a driving current $I_{LED}$ to drive the LED lamp 220.

The sensing unit 244 is used to convert the driving current $I_{LED}$ flowing through the LED in the LED lamp 220 to a sensing voltage signal $V_{sense}$. For example, the aforementioned sensing unit 244 may be a sampling resistor. As shown in FIG. 2, one end of the sampling resistor is electrically connected to the LED lamp 220, and the other end of the sampling resistor is electrically connected to a ground end of the illumination device 200. When the driving current $I_{LED}$ flows through the sampling resistor (i.e. the sensing unit 244), a corresponding voltage difference is formed between two ends of the sampling resistor. Thus, the driving current $I_{LED}$ flowing through the at least one LED in the LED lamp 220 can be converted to the sensing voltage signal $V_{sense}$ by the sampling resistor.

The dimming module 246 includes an input interface 246*a*, a dimming signal generator 246*b* and an isolating unit 246*c*. The input interface 246*a* is used to receive a dimming control signal $V_{LEDctrl}$ inputted from external. For instance, the input interface 246*a* may be a Microprocessor Control Unit (MCU), but not limited thereto. The dimming signal generator 246*b* is used to output a feedback signal $V_{fb1}$ based on the sensing voltage signal $V_{sense}$ and the dimming control signal $V_{LEDctrl}$. The isolating unit 246*c* is used to receive the feedback signal $V_{fb1}$ and output a feedback signal $V_{fb2}$ to the aforementioned power converting module 242.

In this embodiment, as shown in FIG. 2, the aforementioned dimming module 246 further includes an amplifier 246*d* and a filter 246*e*. The amplifier 246*d* is used to amplify the sensing voltage signal $V_{sense}$. The filter 246*e* is used to convert the dimming control signal $V_{LEDctrl}$ to a DC reference voltage signal $V_{ref}$. Further, the aforementioned dimming signal generator 246*b* is used to output the feedback signal $V_{fb1}$ based on the amplified sensing voltage signal $V_{sense}$ and the DC reference voltage signal $V_{ref}$.

In operation, when the LED dimming circuit 240 is under a stable state, the amplified sensing voltage signal $V_{sense}$ and the DC reference voltage signal $V_{ref}$ at are configured to be equipotential to each other. Therefore, the driving current $I_{LED}$ can be adjusted to achieve the dimming control by adjusting the electric potential of the DC reference voltage signal $V_{ref}$.

For example, the aforementioned dimming signal generator 246*b* may be a comparator. When the electric potential of DC reference voltage signal $V_{ref}$ is higher than that of the amplified sensing voltage signal. $V_{sense}$, the electric potential of the feedback signal $V_{fb1}$ outputted by the comparator (i.e. the dimming signal generator 246*b*) will be increased. Therefore, the aforementioned driving current $I_{LED}$ is feedback-adjusted to be relatively high. Alternatively, when the electric potential of the DC reference voltage signal $V_{ref}$ is lower than that of the amplified sensing voltage signal $V_{sense}$, the electric potential of the feedback signal $V_{fb1}$ outputted by the comparator will be reduced, thereby achieving the corresponding dimming control.

Structurally speaking, as shown in FIG. 2, the aforementioned power converting module 242 is electrically connected to the at least one LED in the LED lamp 220. The sensing unit 244 is also electrically connected to the at least one LED in the LED lamp 220. The amplifier 246*d* has an input end and an out put end, and the input end of the amplifier 246*d* is electrically connected to the sensing unit 244. The filter 246*e* has an input end and an out put end, and the input end of the filter 246*e* is electrically connected to the aforementioned input interface 246*a*. The dimming signal generator 246*b* has two input ends and an output end, and one of the two input ends of the dimming signal generator 246*b* is electrically connected to the output end of the amplifier 246*d*, and the other of the two input ends of the dimming signal generator 246*b* is electrically connected to the output end of the filter 246*e*.

In practice, the aforementioned dimming control signal $V_{LEDctrl}$ can be a pulse width modulation (PWM) signal. For achieving the purpose of the dimming control, the electric potential of the DC reference voltage signal $V_{ref}$ can be adjusted by a pulse width of the dimming control signal $V_{LEDctrl}$. For instance, when the pulse width of the dimming control signal $V_{LEDctrl}$ is increased, the electric potential of the DC reference voltage signal $V_{ref}$ is increased accordingly, such that the brightness of the LED lamp 220 is increased by increasing the driving current $I_{LED}$. Alternatively, when the pulse width of the dimming control signal $V_{LEDctrl}$ is reduced, the electric potential of the DC reference voltage signal $V_{ref}$ is reduced accordingly, such that the brightness of the LED lamp 220 is reduced by reducing the driving current $I_{LED}$.

Furthermore, the aforementioned power converting module 242 includes a bridge-type rectifier 242*a*, a transformer 242*b*, a power switch 242*c* and a control module 242*d*. The bridge-type rectifier 242*a* is used to convert the mains supply $V_{AC}$ to a DC voltage $V_{DC}$. The transformer 242*b* is used to output the aforementioned driving current $I_{LED}$ based on the DC voltage. The power switch 242*c* is used to adjust the driving current $I_{LED}$ based on a power control signal $V_{control}$.

As shown in FIG. 2, the bridge-type rectifier 242*a* is electrically connected to the mains supply. The transformer 242*b* has a primary winding and a secondary winding, and the primary winding of the transformer 242*b* is electrically connected to the bridge-type rectifier 242*a* and the secondary winding of the transformer 242*b* is electrically connected to the LED lamp 220. The power switch 242*c* is electrically connected to the primary winding of the transformer 242*b*.

The control module 242*d* is used to output the aforementioned power control signal $V_{control}$ based on the feedback signal $V_{fb2}$. For example, the power control signal $V_{control}$ can be a continuous pulse signal. When the electrical potential of the feedback signal. $V_{fb2}$ is increased, the control module 242*d* increases a duty cycle of the pulse signal, and on-time of the power switch 242*c* is prolonged accordingly, thereby increasing the aforementioned driving current $I_{LED}$. Alternatively, when the electrical potential of the feedback signal $V_{fb2}$ is reduced, the control module 242*d* reduces duty cycle of the pulse signal, and on-time of the power switch 242*c* is reduced accordingly, thereby reducing the aforementioned driving current $I_{LED}$ correspondingly.

The control module 242*d* has an input end and an output end, and the input end of the control module 242*d* is electrically connected to the output end of the isolating unit 246*c*, and the output end of the control module 242*d* is electrically connected to the power switch 242*c*. Generally speaking, the control module 242*d* can be a commercially available power management control chip. Further, the control module 242*d* can also receive the requiring driving voltage, such as the driving voltage $V_{cc}$ as shown in FIG. 2, by the secondary winding of the aforementioned transformer 242*b*.

Further, the aforementioned filter 246*e* can be a RC low pass filter or other forms of low pass filters. A bandwidth setting of the filter 246*e* can be adjusted along with the pulse width of the dimming control signal $V_{LEDctrl}$, in which a person skilled in the art may adjust the bandwidth setting and the pulse width flexibly according to the requirement in practice.

The isolating unit 246*c* has an input end and an output end, and the input end of the isolating unit 246*c* is electrically connected to the output end of the dimming signal generator 246*b*, and the output end of the isolating unit 246*c* is electrically connected to the power converting module 242.

In the present embodiment, the aforementioned isolating unit 246*c* can be a power isolating module or like, such as a photo coupler module and magnetic coupling module, where a user can utilize flexibly according to the requirement in practice. For example, when the isolating unit 246*c* is the photo coupler module, operationally, the photo coupler module is used to receive the feedback signal $V_{fb1}$ and output the feedback signal $V_{fb2}$ by conducting an electric-photo-electric transition inside the photo coupler module. Structurally, the input end of the photo coupler module is electrically connected to the aforementioned dimming signal generator 246*b*, and the output end of the photo coupler module is electrically connected to the input end of the control module 242*d*. Through the feature of power isolation of the isolating unit 246*c*, the operating environment in which the dimming control signal $V_{LEDctrl}$ is received from the input interface 246*a* can be power isolated for avoiding an electrical accident.

In view of the above, the illumination device 200 achieves a feature of power isolation by using the primary winding and the secondary winding of the transformer 242*b* and the isolating unit 246*c*, thus meeting the requirements of safety regulations. Further, the LED dimming circuit 240 decreases the cost of using circuits and increases the power conversion efficiency by using a single-stage type feedback and a dimming control.

Although the present invention has been described above as in detailed description, it is not used to limit the present invention. It will be intended to those skilled in the art that various modifications and variations can be made to the structure of the present invention without departing from the scope or spirit of the invention. Therefore, the scope of the invention is to be defined solely by the appended claims.

What is claimed is:

1. A light-emitting diode (LED) dimming circuit, comprising:

a power converting module for receiving a mains supply and generating a driving voltage to drive a LED;

a sensing unit for converting a driving current flowing through the LED to a sensing voltage signal; and a dimming module, comprising:

an amplifier for amplifying the sensing voltage signal to output an amplified sensing voltage signal;

an input interface for receiving a dimming control signal inputted from external;

a filter for converting the dimming control signal into a DC reference voltage signal;

a dimming signal generator for outputting a first feedback signal based on the amplified sensing voltage signal and the DC reference voltage signal, wherein the dimming signal generator is a comparator; when an electric potential of the DC reference voltage signal is higher than an electric potential of the amplified sensing voltage signal, an electric potential of the first feedback signal outputted by the comparator is increased; when an electric potential of the DC reference voltage signal is lower than an electric potential of the amplified sensing voltage signal, the electric potential of the first feedback signal outputted by the comparator is reduced; and an isolating unit electrically connected between the dimming signal generator and the power converting module, and configured for receiving the first feedback signal and outputting a second feedback signal to the power converting module, thereby feedback-controlling the driving current, wherein the comparator has a first input directly connected to the filter and configured to receive the DC reference voltage signal from the filter, a second input directly connected to the amplifier and configured to receive the amplified sensing voltage signal, and an output directly connected to the isolating unit and configured to output the first feedback signal to the isolating unit.

2. The LED dimming circuit of claim 1, wherein the filter comprises a RC low pass filter.

3. The LED dimming circuit of claim 1, wherein the dimming control signal is a pulse width modulation (PWM) signal.

4. The LED dimming circuit of claim 1, wherein the sensing unit comprises a sampling resistor, and one end of the sampling resistor is electrically connected to the LED, and the other end of the sampling resistor is electrically connected to a ground end for converting the driving current flowing through the LED to the sensing voltage signal.

5. The LED dimming circuit of claim 1, wherein the power converting module comprises:

a bridge-type rectifier for converting the mains supply to a DC voltage;

a transformer for outputting the driving current based on the DC voltage;

a power switch for adjusting the driving current based on a power control signal; and a control module for outputting the power control signal based on the second feedback signal.

6. The LED dimming circuit of claim 1, wherein the isolating unit comprises a photo coupler module for receiving the first feedback signal and outputting the second feedback signal.

7. An illumination device, comprising:

a LED dimming circuit, comprising:

a power converting module for receiving a mains supply and generating a driving voltage to drive a LED;

a sensing unit for converting a driving current flowing through the LED to a sensing voltage signal;

a dimming module, comprising:

an amplifier for amplifying the sensing voltage signal to output an amplified sensing voltage signal;

an input interface for receiving a dimming control signal inputted from external;

a filter for converting the dimming control signal into a DC reference voltage signal, a dimming signal generator for outputting a first feedback signal based on the amplified sensing voltage signal and the DC reference voltage signal, wherein the dimming signal generator is a comparator; when an electric potential of the DC reference voltage signal is higher than an electric potential of the amplified sensing voltage signal, an electric potential of the first feedback signal outputted by the comparator is increased; when an electric potential of the DC reference voltage signal is lower than an electric potential of the amplified sensing voltage signal, the electric potential of the first feedback signal outputted by the comparator is reduced; and an isolating unit electrically connected between the dimming signal generator and the power converting module, and configured for receiving the first feedback signal and outputting a second feedback signal to the power converting module, thereby feedback-controlling the driving current, wherein the comparator has a first input directly connected to the filter and configured to receive the DC reference voltage signal from the filter, a second input directly connected to the amplifier and configured to receive the amplified sensing voltage signal, and an output directly connected to the isolating unit and configured to output the first feedback signal to the isolating unit;

a LED lamp electrically connected to the power converting module of the LED dimming circuit.

8. The illumination device of claim 7, wherein the filter comprises a RC low pass filter.

9. The illumination device of claim 7, wherein the dimming control signal is a pulse width modulation (PWM) signal.

10. The illumination device of claim 7, wherein the sensing unit comprises a sampling resistor, and one end of the sampling resistor is electrically connected to the LED, and the other end of the sampling resistor is electrically connected to a ground end for converting the driving current flowing through the LED to the sensing voltage signal.

11. The illumination device of claim 7, wherein the power converting module comprises:

a bridge-type rectifier for converting the mains supply to a DC voltage;

a transformer for outputting the driving current based on the DC voltage;

a power switch for adjusting the driving current based on a power control signal; and a control module for outputting the power control signal based on the second feedback signal.

12. A LED dimming circuit, comprising:

a power converting module electrically connected to a LED, and the power converting module for receiving a mains supply and generating a driving voltage to drive the LED;

a sensing unit electrically connected to the LED, and the sensing unit for converting a driving current flowing through the LED to a sensing voltage signal;

an amplifier with an input end and an output end, the input end of the amplifier electrically connected to the sensing unit, the amplifier for amplifying the sensing voltage signal to output an amplified sensing voltage signal;

an input interface;

a filter with an input end and an output end, the input end of the filter electrically connected to the input interface, the filter for converting the dimming control signal into a DC reference voltage signal;

a dimming signal generator with two input ends and an output end, and one of the two input ends of the dimming signal generator directly electrically connected to the output end of the amplifier, and the other of the two input ends of the dimming signal generator electrically connected to the output end of the filter, wherein the dimming signal generator is a comparator; when an electric potential of the DC reference voltage signal is higher than an electric potential of the amplified sensing voltage signal, an electric potential of an first feedback signal outputted by the comparator is increased; when an electric potential of the DC reference voltage signal is lower than an electric potential of the amplified sensing voltage signal, the electric potential of the first feedback signal outputted by the comparator is reduced; and an isolating unit with an input end and an output end, and the input end of the isolating unit electrically connected to the output end of the dimming signal generator, and the output end of the isolating unit electrically connected to the power converting module, wherein the isolating unit is electrically connected between the dimming signal generator and the power converting module, wherein the comparator has a first input directly connected to the filter and configured to receive the DC reference voltage signal from the filter, a second input directly connected to the amplifier and configured to receive the amplified sensing voltage signal, and an output directly connected to the isolating unit and configured to output the first feedback signal to the isolating unit.

13. The LED dimming circuit of claim 12, wherein the sensing unit comprises a sampling resistor, and one end of the sampling resistor is electrically connected to the LED, and the other end of the sampling resistor is electrically connected to a ground end.

14. The LED dimming circuit of claim 12, wherein the power converting module comprises:

a bridge-type rectifier electrically connected to a mains supply;

a transformer with a primary winding and a secondary winding, wherein the primary winding of the transformer is electrically connected to the bridge-type rectifier and the secondary winding of the transformer is electrically connected to the LED;

a power switch electrically connected to the primary winding of the transformer; and a control module with an input end and an output end, and the input end of the control module electrically connected to the output end of the isolating unit, and the output end of the control module electrically connected to the power switch.

15. The LED dimming circuit of claim 14, wherein the isolating unit comprises a photo coupler module with an input end and an output end, wherein the input end of the photo coupler module is electrically connected to the dimming signal generator, and the output end of the photo coupler module is electrically connected to the input end of the control module.

16. The LED dimming circuit of claim 12, wherein the filter comprises a RC low pass filter.

17. An illumination device, comprising:

a LED dimming circuit, comprising:

a power converting module electrically connected to a LED, and the power converting module for receiving a mains supply and generating a driving voltage to drive the LED;

a sensing unit electrically connected to the LED, and the sensing unit for converting a driving current flowing through the LED to a sensing voltage signal;

an amplifier with an input end and an output end, the input end of the amplifier electrically connected to the sensing unit, the amplifier for amplifying the sensing voltage signal to output an amplified sensing voltage signal;

an input interface;

a filter with an input end and an output end, the input end of the filter electrically connected to the input interface, the filter for converting the dimming control signal into a DC reference voltage signal;

a dimming signal generator with two input ends and an output end, and one of the two input ends of the dimming signal generator directly electrically connected to the output end of the amplifier, and the other of the two input ends of the dimming signal generator electrically connected to the output end of the filter, wherein the dimming signal generator is a comparator; when an electric potential of the DC reference voltage signal is higher than an electric potential of the amplified sensing voltage signal, an electric potential of an first feedback signal outputted by the comparator is increased; when an electric potential of the DC reference voltage signal is lower than an electric potential of the amplified sensing voltage signal, the electric potential of the first feedback signal outputted by the comparator is reduced; and an isolating unit with an input end and an output end, and the input end of the isolating unit electrically connected to the output end of the dimming signal generator, and the output end of the isolating unit electrically connected to the power converting module, wherein the isolating unit is electrically connected between the dimming signal generator and the power converting module, wherein the comparator has a first input directly connected to the filter and configured to receive the DC reference voltage signal from the filter, a second input directly connected to the amplifier and configured to receive the amplified sensing voltage signal, and an output directly connected to the isolating unit and configured to output the first feedback signal to the isolating unit; and a LED lamp electrically connected to the power converting module of the LED dimming circuit.

18. The illumination device of claim 17, wherein the sensing unit comprises a sampling resistor, and one end of the sampling resistor is electrically connected to the LED, and the other end of the sampling resistor is electrically connected to a ground end.

19. The illumination device of claim 17, wherein the power converting module comprises:

a bridge-type rectifier electrically connected to a mains supply;

a transformer with a primary winding and a secondary winding, wherein the primary winding of the transformer is electrically connected to the bridge-type rectifier and the secondary winding of the transformer is electrically connected to the LED;

a power switch electrically connected to the primary winding of the transformer; and a control module with an input end and an output end, and the input end of the control module electrically connected to the output end of the isolating unit, and the output end of the control module electrically connected to the power switch.

20. The illumination device of claim 19, wherein the isolating unit comprises a photo coupler module with an input end and an output end, wherein the input end of the photo coupler module is electrically connected to the dimming signal generator, and the output end of the photo coupler module is electrically connected to the input end of the control module.

21. The illumination device of claim 17, wherein the filter comprises a RC low pass filter.

* * * * *